US006239682B1

(12) United States Patent
McCloskey

(10) Patent No.: US 6,239,682 B1
(45) Date of Patent: May 29, 2001

(54) INSERT FOR EXPANDABLE TRANSFORMER ENCLOSURE

(75) Inventor: Scott C. McCloskey, Chula Vista, CA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/329,120

(22) Filed: Jun. 9, 1999

(51) Int. Cl.[7] ..... H01F 27/02
(52) U.S. Cl. ..... 336/90; 336/92
(58) Field of Search ..... 336/90, 92; 361/836, 361/728

(56) References Cited

U.S. PATENT DOCUMENTS

| | | | |
|---|---|---|---|
| 3,602,629 | 8/1971 | Friedrich et al. . | |
| 3,668,351 | 6/1972 | Walbrun et al. . | |
| 4,868,532 | 9/1989 | Ehrenhalt et al. . | |
| 5,025,949 | 6/1991 | Adkins et al. . | |
| 5,029,054 | 7/1991 | Trainor . | |
| 5,177,325 | 1/1993 | Giammanco . | |
| 5,363,079 | 11/1994 | Zawada et al. . | |
| 5,864,276 | 1/1999 | Willie . | |
| 5,900,796 * | 5/1999 | Parker | 336/92 |

* cited by examiner

*Primary Examiner*—Anh Mai
(74) *Attorney, Agent, or Firm*—Michael J. Femal; Larry I. Golden

(57) ABSTRACT

An expandable transformer housing having a first housing member with a hollow cavity therein, a second housing member with a hollow cavity therein, and at least one exterior insert member therebetween in a stacked formation. The exterior insert member has a first end and a second end. A portion of the first end of the exterior insert member is adapted to engage the first housing member and a portion of the second end of the insert member is adapted to engage the second housing member. An interior insert member is also provided having a first end and a second end. A portion of the first end of the interior insert member is similarly adapted to engage the first housing member and a portion of the second end of the interior insert member is adapted to engage the second housing member. The interior insert provides insulation between the current source and the second windings of the transformer. The exterior and interior inserts are designed to expand the mounting depth of the transformer's enclosure to provide a stacked design in an interlocking manner.

25 Claims, 4 Drawing Sheets

INSERT FOR EXPANDABLE TRANSFORMER ENCLOSURE

TECHNICAL FIELD

The present invention relates generally to enclosures for encapsulating electrical transformers and, more particularly, to expandable enclosures for encapsulating various sizes of current transformers.

BACKGROUND OF THE INVENTION

Transformers are used extensively in electrical and electronic applications. Transformers are useful to step voltages up or down, to couple signal energy from one stage to another, and for impedance matching. Transformers are also useful for sensing current and powering electronic trip units for circuit interrupters such as circuit breakers and other electrical distribution devices. Other applications for transformers include magnetic circuits with solenoids and motor stators. Generally, a transformer consists of two or more windings (primary and secondary, etc . . . ) interlinked by a mutual magnetic field. As such, the transformer is used to transfer electric energy from one circuit to another circuit using magnetic induction.

Current transformers are used to monitor current flow in a circuit, such as to detect excessive power consumption and provide a warning signal or disconnect the power supply. The transformer must be protected from potential hazzards in its immediate environment with some type of sealing enclosure. Current transformers, as well as transformers in general, are shape and size specific to the end user's electrical needs and mounting specifications. Accordingly, this presents a unique challenge to designing and manufacturing a transformer and an enclosure therefor which delivers the required electrical performance with the required mounting specifications, all in the confines of a secure enclosure.

Various types of sealing enclosures are currently utilized to protect the transformer from the environment. One means for protecting transformers includes entirely sealing the transformer assembly with an epoxy resin. This is accomplished by pouring the epoxy resin into a molded container which houses the transformer to completely surround and encase the transformer coil with the epoxy resin. Epoxy is utilized because it prevents impact or vibrational shock from affecting the function of the transformer. However, several drawbacks are associated with epoxy encapsulated transformers: (1) using epoxy to encapsulate the transformer is a time consuming process, and (2) the use of epoxy prevents subsequent repairs to the transformer since the transformer is permanently encapsulated by the epoxy.

Another means for encapsulating transformers includes fastening two separate enclosures together. Typically, the enclosure comprises of two housinghalves which are connected by screws. As with an epoxy enclosure, this type of housing also has several drawbacks. One specific drawback is the increased capital investments in tooling required for each different enclosure. Typically, as the electrical specifications change for a specific transformer, the size of the transformer also changes. Accordingly, the enclosure for the transformer must also be modified. It is very common, however, for the change in transformer size to effect the depth of the transformer, and not the width or height. Thus, modifying the depth of a transformer requires modifying the mounting depth of the enclosure which results in the tooling of a new molded enclosure. The cost of new tooling is very expensive.

Accordingly, there is a need for an effective and efficient means for providing a protective enclosure for encapsulating various sizes of transformers, and specifically current transformers. Such an enclosure must not only provide all of the necessary safety features, but should also allow for quick assembly/disassembly of the enclosure and accessibility for repairs of the transformer. Additionally, the enclosure should eliminate the need for new tooling and additional capital expenditures for manufacturing a variety of sizes of transformer enclosures.

SUMMARY OF THE INVENTION

The transformer enclosure or housing of the present invention allows for the incremental expansion in mounting depth of the enclosure for a transformer without having to invest additional money in new tooling. The transformer enclosure of the present invention also allows for subsequent disassembly of the enclosure for repair of the transformer therein, as required.

According to one aspect of the present invention, the housing includes a first housing member, a second housing member, and an exterior insert member between the first and second housing members. The insert member has a first end and a second end. A portion of the first end of the insert member is adapted to engage the first housing member, and a portion of the second end of the insert member is adapted to engage the second housing member. The insert member comprises an exterior shell member which increases the length of the housing, and thus the interior volume of the housing, to allow the housing to accept larger transformers without manufacturing larger housing halves.

According to another aspect of the present invention, an aperture is provided through the center of the housing. An interior insert member is provided to bridge the gap adjacent the aperture, i.e., between the first and second housing members, similar to the exterior insert member. Like the exterior insert member, the interior insert member has a first end and a second end. A portion of the first end of the interior insert member is adapted to engage the first housing member adjacent the aperture therethrough, and a portion of the second end of the insert member is adapted to engage the second housing member adjacent the aperture therethrough. Like the exterior insert member, the interior insert member generally comprises an exterior shell member adjacent the aperture which increases the length of the aperture housing, and thus the interior volume of the housing, to allow the housing to accept larger transformers. Generally, the interior and exterior insert members have a height dimension that is substantially equal.

According to another aspect of the present invention, the first and second housing members, along with the interior and exterior insert members, have mating members which allow adjacent housing and insert members to engage and mate with one another in a stackable manner. In one of the preferred embodiments of the present invention, the mating members comprise an integral female recess, and an integral male lip or protrusion. Specifically, in a housing having a single interior and exterior insert: (1) the first housing member has an exterior male lip that depends from substantially the perimeter of an outer wall of the first housing member, and an interior male lip that depends from substantially the perimeter of the wall adjacent the aperture thereof; (2) the second housing member has an exterior female recess that depends from substantially the perimeter of an outer wall of the second housing member, and an interior female recess that depends from substantially the perimeter of the wall adjacent the aperture thereof; (3) the exterior insert has a female recess that depends from substantially the perimeter of the first end of the exterior insert, and a male lip that depends from substantially the perimeter of the second end of the exterior insert; and, (4) the interior insert has a female recess that depends from substantially the perimeter of the first end of the interior insert, and a male lip that depends from substantially the perimeter of the second end of the interior insert. As such, the respective male lips of the first housing member engage and mate with the respective female recess of the first end of each of the interior and exterior inserts, and the respective female recesses of the second housing member engage and mate with the respective male lip of the second end of each of the interior and exterior inserts, respectively.

According to another aspect of the present invention, a plurality of interior and exterior inserts are provided to sequentially expand the depth of the transformer housing. Each insert member has respective mating members substantially as described above.

According to another aspect of the present invention, the first and second housing members, along with the plurality of inserts therebetween, are fixed together to encapsulate the transformer therein.

Other features and advantages of the invention will be apparent from the following specification taken in conjunction with the following drawings.

Brief Description of the Drawings

To understand the present invention, it will now be described by way of example, with reference to the accompanying drawings in which.

DETAILED DESCRIPTION OF THE PREFERRED EMBODIMENT

Figure 1:
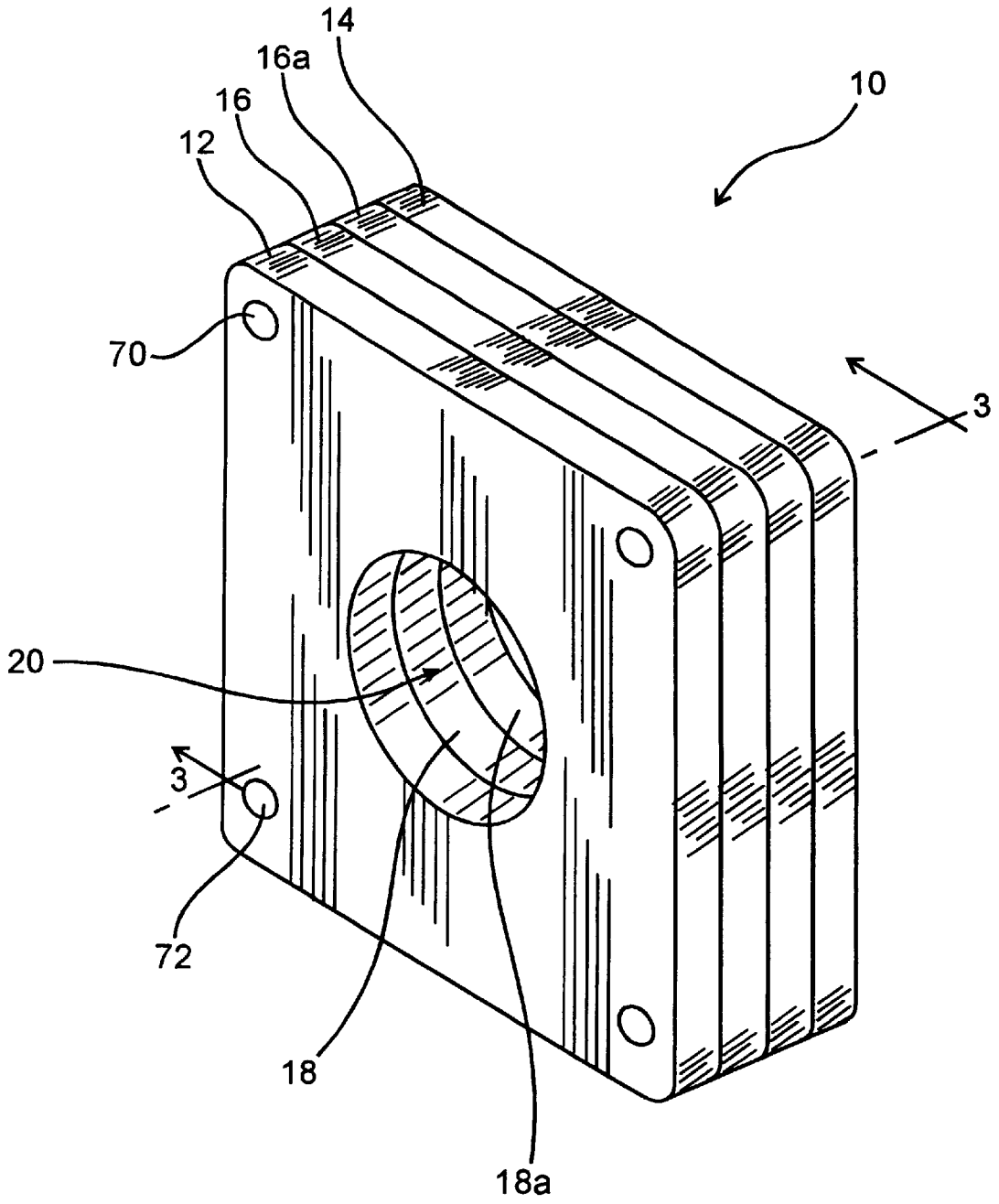
FIG. 1 is a perspective view showing an expandable enclosure for a transformer housing according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
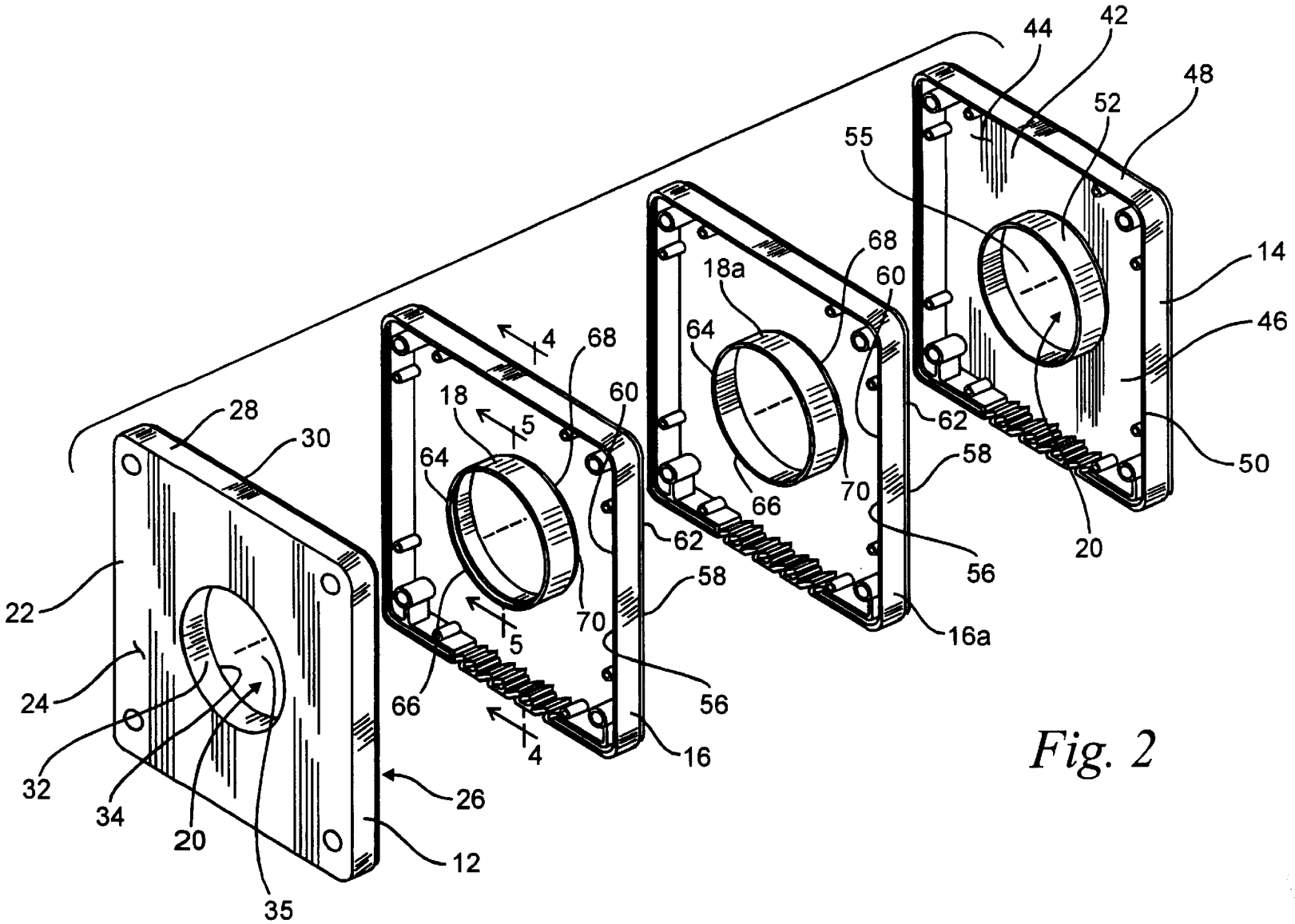
FIG. 2 is an exploded perspective view of the expandable transformer enclosure of FIG. 1.

Referring now in detail to the Figures, and initially to FIGS. 1 and 2, there is shown an expandable housing 10 for a transformer (not shown). The expandable housing 10 is configured to surround and encase the transformer to protect the transformer from damage from the outside environment. The expandable housing 10 includes a first housing member 12, a second housing member 14, two exterior insert members 16,16*a* and two interior insert members 18,18*a*. The interior insert members 16,16*a* and exterior insert members 18,18*a* are located between the first and second housing members 12, 14. Each of the members 12,14,16,16*a*,18,18*a* are adapted to interconnect and engage or mate with adjacent members via interconnecting means in a stackable manner. Accordingly, if additional insert members (16 . . . 16*n*),(18 . . . 18*n*) are required to expand the transformer housing 10, such insert members are merely located between the first and second housing members 12,14 in an interconnected, engaging, and stacked manner, resulting in more separation between enclosure halves. The stacking of the inserts is only limited by the requirements on the depth of the mounting for the transformers.

The embodiment illustrated in the Figures has an aperture 20 extending from the first housing member 12 to the second housing member 14 which allows for current transformers. Specifically, the aperture 20 and the inner insert members 18,18*a* allow for a bus bar (not shown) or the primary and secondary windings (not shown) to pass through the aperture 20 in the housing members. The aperture 20 in the housing 10 provides insulation between the customer's current source and the secondary windings of the current transformer.

Figure 3:
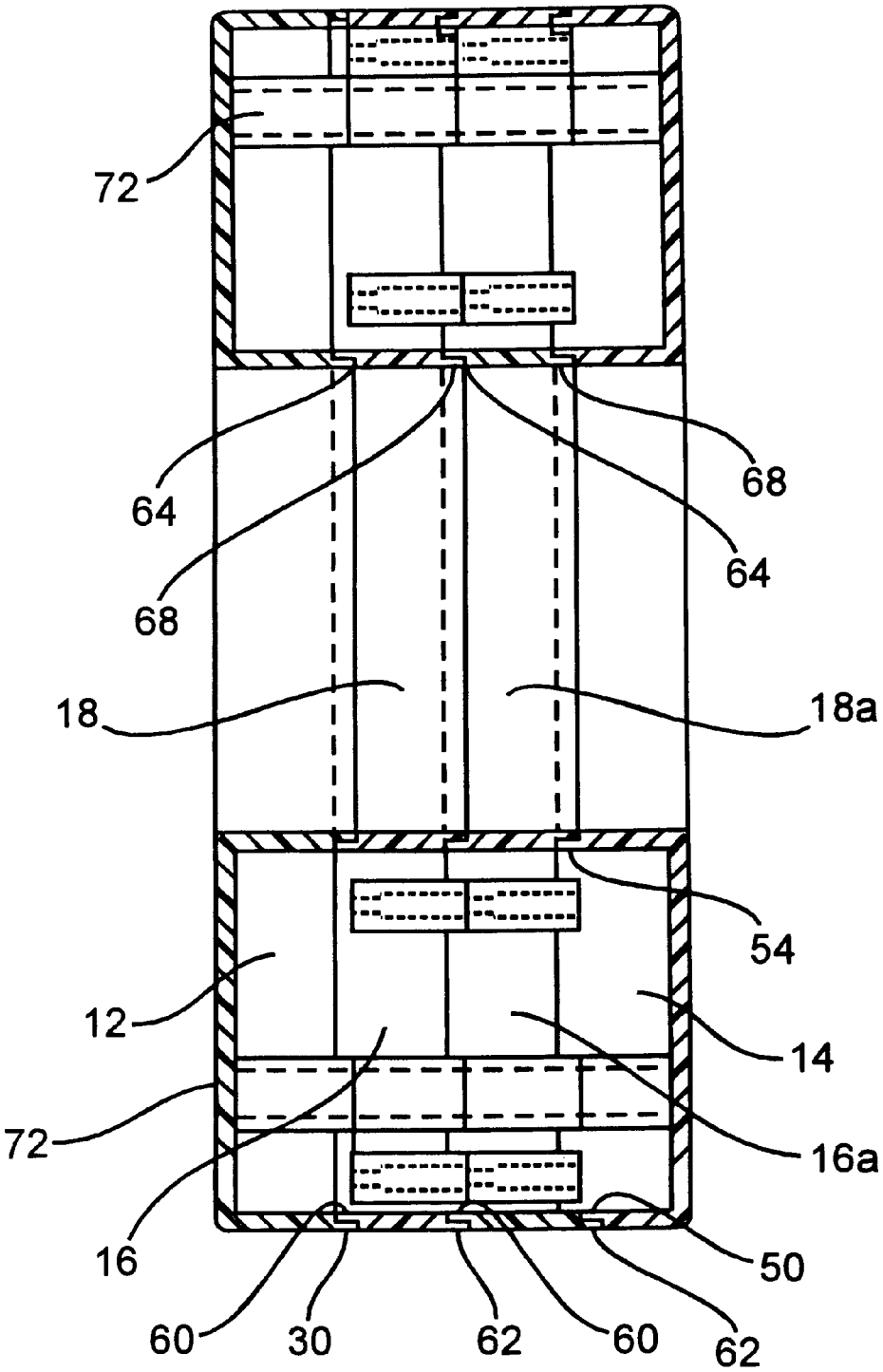
FIG. 3 is a cross-sectional view taken along line 3–3 of FIG. 1.

As shown in FIGS. 2 and 3, the first housing member 12 has a closed end 22 defined by a back wall 24 with an aperture 20 therethrough, and an open end 26 opposing the closed end 22. An outer wall 28 depends from the back wall 24, and a first exterior mating member 30 depends from a perimeter of the outer wall 28 adjacent the open end 26 thereof Additionally, an interior wall 32 depends from the back wall 24 and a first interior or inner mating member 34 depends from a perimeter of the interior wall 32 adjacent the aperture 20 of the first housing member 12. The combination of the back wall 24, outer wall 28, and interior wall 32 defines a hollow cavity 35 in the housing member 12.

Similarly, the second housing member 14 has a closed end 42 defined by a back wall 44 with an aperture 20 therethrough, and an open end 46 opposing the closed end 42. An outer wall 48 depends from the back wall 44, and a second exterior mating member 50 depends from a perimeter of the outer wall 48 adjacent the open end 46 thereof. Additionally, an interior wall 52 depends from the back wall 44 and a second interior or inner mating member 54 depends from a perimeter of the interior wall 52 adjacent the aperture 20 of the second housing member 14. The combination of the back wall 44, outer wall 48, and interior wall 52 defines a hollow cavity 55 in the housing member 14.

Figure 4:
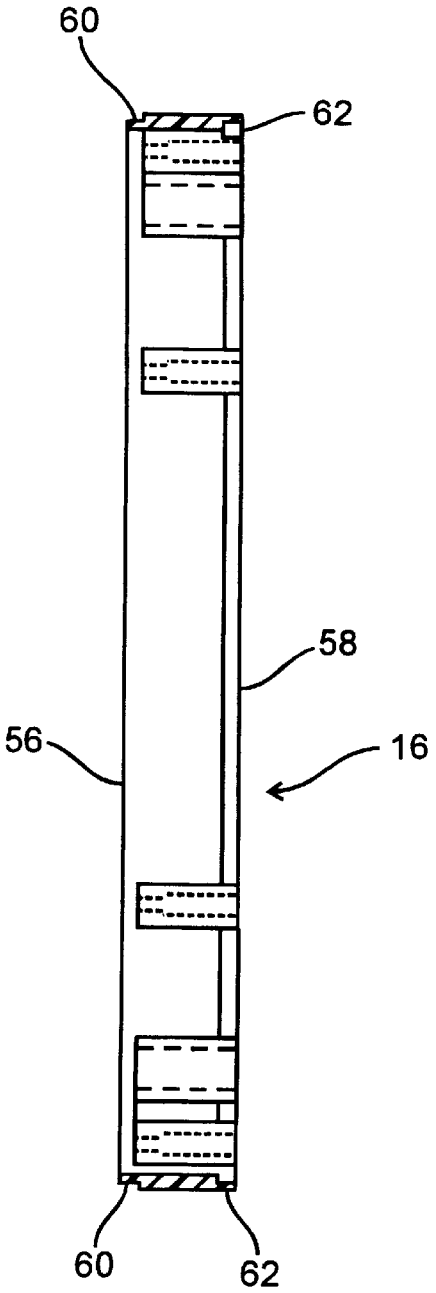
FIG. 4 is a cross-sectional view taken along line 4–4 of FIG. 2; and, FIG. 5 is a cross-sectional view taken along line 5–5 of FIG. 2.

As illustrated in FIGS. 2–4, the first exterior insert member 16 and the second exterior insert member 16*a* are located between the first housing member 12 and the second housing member 14. In this embodiment, with two exterior insert members 16,16*a*, the first exterior insert member 16 is specifically located between and adjacent the first housing member 12 and the second exterior insert member 16*a*, and the second exterior insert member 16*a* is specifically located between and adjacent the first exterior insert member 16 and the second housing member 14. The first and second exterior insert members 16,16*a* each have a first end 56 and a second end 58 opposing the first end 56. As shown in FIG. 4, first mating member 60 is adjacent the first end 56 of the exterior insert members 16,16*a*, and a second mating member 62 is adjacent the second end 58 of the exterior insert members 16,16*a*. As illustrated in FIGS. 2 and 3, the first mating member 60 of the first exterior insert member 16 is adapted to and is capable of engaging and mating with the first exterior mating member 30 of the first housing member 12. The second mating member 62 of the first exterior insert member 16 is adapted to and is capable of engaging and mating with the first mating member 60 of the second exterior insert member 16*a*. And, the second mating member 62 of the second exterior insert member 16*a* is adapted to and is capable of engaging and mating with the second exterior mating member 50 of the second housing member 14.

Figure 5:
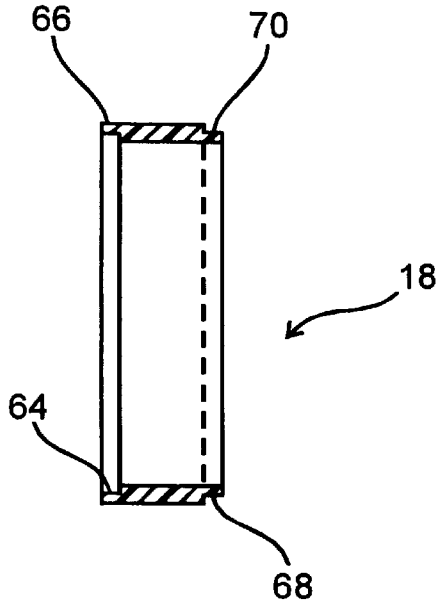

Additionally, a first interior insert member 18 and a second interior insert member 18*a* are located between the first housing member 12 and the second housing member 14. The interior insert members 18,18*a* are generally located within the confines of exterior insert members 16,16*a*. In this embodiment with two interior insert members 18,18*a*, best illustrated in FIGS. 2 and 3, the first interior insert member 18 is specifically located between the first housing member 12 and the second interior insert member 18*a*, and the second interior insert member 18*a* is specifically located between the first interior insert member 18 and the second housing member 14. As shown in FIG. 5, each of the first and second interior insert members 18,18*a*, have a first mating member 64 adjacent a first end 66 thereof, and a second mating member 68 adjacent a second end 70 thereof. The first end 66 of each interior insert member 18,18*a* opposes the second end 70 of each interior insert member 18,18*a*. As illustrated in FIG. 2, the first mating member 64 of the first interior insert member 18 is adapted to engage and mate with the first interior mating member 34 of the first housing member 12. The second mating member 68 of the first interior insert member 18 is adapted to engage and mate with the first mating member 64 of the second interior insert member 18*a*. And, the second mating member 68 of the second interior insert member 18*a* is adapted to engage and mate with the second interior mating member 54 of the second housing member 14.

As such, the first housing member 12, the first and second exterior and interior mating members 16,16*a*, 18,18*a*, and the second housing member 14 are all connectable to form the stackable transformer housing 10 of the present invention.

For purposes of mating adjacent members, in the preferred embodiments each housing member 12,14 and insert member 16,16*a*,18,18*a* generally has a male mating means or a female mating means at one end thereof. In the preferred embodiments, as best shown in FIGS. 2–5, the first exterior mating member 30 of the first housing member 12 is a male means or a protrusion 30 extending from the perimeter of the outer wall 28 of the first housing member 12, and the second exterior mating member 50 of the second housing member 14 is a female means or an indentation 50 adjacent the perimeter of the outer wall 48 of the second housing member 14. Also as shown in FIGS. 2–5, the exterior insert members 16,16*a*, and the interior insert members 18,18*a*, have a male means or protrusion extending from one end thereof, generally the second end, and have a female means or indentation adjacent the other end thereof, generally the first end.

Further, the male mating member or means in the illustrated embodiment can also be identified as an integral lip about a perimeter of the end thereof, and the female mating member or means can also be identified as an integral recess adjacent the end thereof The male means, protrusion, or lip of any member identified herein is dimensioned to engage the female means, indentation, or recess of any adjacent member identified herein. In general, the male mating member of any component is capable of mating with the female mating member of any other component to form an encapsulating exterior portion of the transformer housing 10. While the male mating means in the preferred embodiment is identified as a protrusion or lip and the female mating means in the preferred embodiment is identified as an indentation or recess, other mating means are also viable, including threaded means, gasket means, adhesives, mechanical fasteners, etc . . . .

As best shown in FIG. 3, (starting from the left most housing member 12 and continuing to the right most housing member 14 in FIG. 2) the male lip of the first exterior mating member 30 engages the female recess of the first mating member 60 of the first exterior insert member 16; the male lip of the first interior mating member 34 engages the female recess of the first mating member 64 of the first interior insert member 18; the male lip of the second mating member 62 of the first exterior insert member 16 engages the female recess of the first mating member 60 of the second exterior insert member 16*a*; the male lip of the second mating member 68 of the first interior insert member 18 engages the female recess of the first mating member 64 of the second interior insert member 18*a*; the male lip of the second mating member 62 of the second exterior insert member 16*a* engages the female recess of the second exterior mating member 50 of the second housing member 14; and, the male lip of the second mating member 68 of the second interior insert member 18*a* engages the female recess of the second interior mating member 54 of the second housing member 14. The members are then drawn together, generally with the use of screws, and are then fixed together.

Each insert member, both interior and exterior, has a height dimension (H). Generally, the height dimension (H) of the exterior and interior insert members is substantially equal. Accordingly, with current transformers, for each exterior insert member 16 added to the expandable housing 10 an interior insert member 18 will also be required. Also, the height dimension of the first and second housing members 12,14 may be greater or less than the height dimension of the insert members 16,18.

The above described housing components and mating elements thereof allow for a transformer housing 10 including: (1) a first housing member 12 and a second housing member 14 only, and no insert members; (2) one pair of mating members 16,18 between first and second housing members 12,14; (3) two pair of mating members 16,16*a*, 18,18*a* between first and second housing members 12,14; (4) three pair of mating members 16,16*a*,16*b*,18,18*a*,18*b* between first and second housing members 12,14; and so on and so forth, etc . . . .

Additionally, it is understood that with certain transformers, interior insert members and apertures through the back wall of the housing members are not required. In such instances, if the housing 10 is required to be expanded to contain a larger transformer, additional exterior insert members 16 are merely inserted and mated between the first and second housing members 12,14. In the embodiment wherein no mating members are utilized the first exterior mating member 30 of the first housing member 12 mates with the second exterior mating member 50 of the second housing member 14, and the first interior mating member 34 of the first housing member 12 mates with the second interior mating member 54 of the second housing member 14.

When all components of the transformer housing 10 have been mated together in the above stated manner, the enclosure 10 is sealed. Generally, screws Is 15 placed in a tapped hole of the housing complete the securement of the housing. Then, wire terminals (not shown) are connected to the housing, fixed in place, and external wire leads are connected to the final transformer enclosure assembly. Finally, the transformer housing 10 is mounted with mounting fixtures placed through the mounting holes 72 in the housing 10.

In the embodiments disclosed the first housing member 12 is shown to have male mating members 30,34, and the second housing member 14 is shown to have female mating members 50,54. It is possible, however, that the mating members of the first housing member 12 may possess female characteristics, and the mating members of the second housing member 14 may possess male characteristics. Additionally, both the first housing member 12 and the second housing member 14 may contain all male mating members or all female mating members as long as the insert members 16,18 have the appropriate corresponding mating members.

While the specific embodiments have been illustrated and described, numerous modifications come to mind without significantly departing from the spirit of the invention, and the scope of protection is only limited by the scope of the accompanying Claims.

What is claimed is:

1. A housing for enclosing a transformer comprising:

a first housing member having a hollow cavity therein;

a second housing member having a hollow cavity therein; and, an insert member between the first housing member and the second housing member, the insert member having a first end and a second end, a portion of the first end of the insert member engaging the first housing member and a portion of the second end of the insert member engaging the second housing member, wherein the insert member increases the distance between the first and second housing members.

2. The housing of claim 1, further comprising two insert members between the first and second housing members, each insert member having a first end and a second end, wherein the first end of a first of the two insert members engages the first housing member, the second end of the first of the two insert members engages the first end of a second of the two insert members, and wherein the second end of the second of the two insert members engages the second housing member.

3. The housing of claim 1, further comprising a plurality of insert members including a first insert member adjacent the first housing member, a second insert member adjacent the second housing member and at least one additional insert member between the first and second housing members, each insert member having a first end and a second end, wherein the first end of the first insert member engages the first housing member, wherein the second end of the second insert member engages the second housing member, and wherein the additional insert members mate with adjacent insert members to form the transformer housing.

4. The housing of claim 3, wherein the plurality of insert members are adapted to engage adjacent insert members in a stackable manner, the first housing member being located adjacent one insert member, the second housing member being located adjacent another insert member, and the remaining insert members located therebetween.

5. The housing of claim 1, further comprising an interior insert member having a first end and a second end, a portion of the first end of the interior insert member engaging the first housing member and a portion of the second end of the interior insert member engaging the second housing member.

6. The housing of claim 5, wherein the insert member has a height dimension and the interior insert member has a height dimension, the height dimension of the insert member being substantially equal to the height dimension of the interior insert member.

7. The housing of claim 5, wherein both the insert member and the interior insert member have a male means extending from one end thereof, and wherein both the insert member and the interior insert member have a female means adjacent the other end thereof.

8. The housing of claim 1, wherein the second end of the insert member has a protrusion extending therefrom and wherein the first end of the insert member has an indentation, the protrusion of the insert member dimensioned to engage a mating indentation on the second housing member and the indentation of the insert member dimensioned to engage a mating protrusion extending from the first housing member.

9. The housing of claim 8, further comprising a second insert member, the second end of the second insert member having a protrusion extending therefrom and the first end of the second insert member having an indentation, the indentation of the second insert member dimensioned to engage the protrusion of the insert member and the protrusion of the second insert member dimensioned to engage a mating indentation of the second housing member.

10. The housing of claim 8, wherein the protrusion of the insert member engages an end portion of the second housing member and the indentation of the insert member engages an end portion of the first housing member, and wherein the housing further comprising an interior insert member having a protrusion extending from a second end thereof and an indentation at the first end thereof, the protrusion of the interior insert member dimensioned to engage an inner portion of the second housing member and the indentation of the interior insert member dimensioned to engage an inner portion of the first housing member.

11. A transformer housing for enclosing a transformer comprising:

a first housing member and a second housing member, wherein one of either the first housing member or the second housing member has a first mating member and the other of either the first housing member or the second housing member has a second mating member; and, a first insert member between the first housing member and the second housing member, wherein the first insert member has a first mating member at a first end thereof and a second mating member at a second end thereof, the first mating member of the first insert member mating with the second mating member of either the first housing member or the second housing member, and the second mating member of the first insert member mating with the first mating member of the other of either the first housing member or the second housing member to form an encapsulating exterior portion of the transformer housing.

12. The transformer housing of claim 11, further comprising a second insert member between the first housing member and the second housing member, and adjacent the first insert member, the second insert member having a first mating member at a first end thereof and a second mating member at a second end thereof.

13. The transformer housing of claim 11, further comprising a first interior insert member between the first housing member and the second housing member, wherein the first interior insert member has a first mating member at a first end thereof and a second mating member at a second end thereof, the first mating member of the first interior insert member mating with an inner second mating member of either the first housing member or the second housing member, and the second mating member of the first interior insert member mating with an inner first mating member of the other of either the first housing member or the second housing member.

14. The transformer housing of claim 13, further comprising a second insert member between the first and second housing members, and adjacent the first insert member, and a second interior insert member between the first and second housing members, and adjacent the first interior insert member.

15. The transformer housing of claim 11, wherein the first mating member of the first insert member comprises an integral recess adjacent the first end thereof, and wherein the second mating member of the first insert member comprises an integral lip about a perimeter of the second end thereof.

16. The transformer housing of claim 15, wherein the first mating member of the housings depends from an outer wall of the first housing member, and wherein the second mating member of the housings depends from an outer wall of the second housing member.

17. The transformer housing of claim 16, wherein the first housing member has a hollow cavity with an aperture therethrough, and wherein the second housing has a hollow cavity with an aperture therethrough.

18. The transformer housing of claim 17, wherein the first housing member has an inner mating member adjacent the perimeter of the aperture therein, wherein the second housing member has an inner mating member adjacent the perimeter of the aperture therein, wherein a first end of an interior insert member engages the inner mating member of the first housing member, and wherein a second end of the interior insert member engages the inner mating member of the second housing member.

19. A stackable housing for a transformer comprising:

a first housing member having a closed end with an aperture therethrough and an open end opposing the closed end, wherein a first exterior mating member depends from a perimeter of an outer wall of the first housing member adjacent the open end thereof, and wherein a first interior mating member depends from a perimeter of an interior wall of the first housing member adjacent the aperture;

a second housing member having a closed end with an aperture therethrough and an open end opposing the closed end, wherein a second exterior mating member depends from a perimeter of an outer wall of the second housing member adjacent the open end thereof, and wherein a second interior mating member depends from a perimeter of an interior wall of the second housing member adjacent the aperture;

a first exterior insert member located between the first housing member and the second housing member, the first exterior insert member having a first mating member adjacent the first end thereof, and a second mating member adjacent a second end thereof, wherein the first mating member of the first exterior insert member is dimensioned to engage the first exterior mating member of the first housing member, and wherein the second mating member of the first exterior insert member is dimensioned to engage the second exterior mating member of the second housing member; and, a first interior insert member located between the first housing member and the second housing member, and interior of the first exterior insert member, the first interior insert member having a first mating member adjacent a first end thereof and a second mating member adjacent a second end thereof, wherein the first mating member of the first interior insert member is dimensioned to engage the first interior mating member of the first housing member, wherein the second mating member of the first interior insert member is dimensioned to engage the second interior mating member of the second housing member, wherein the first housing member, the second housing member, the first interior insert member and the first exterior insert member are connectable to form the stackable transformer housing.

20. The stackable housing of claim 19, further comprising a second exterior insert member between the first and second housing members, and a second interior insert member between the first and second housing members, the second exterior insert member adjacent the first exterior insert member and the second interior insert member adjacent the second interior insert member.

21. The stackable housing of claim 19, further comprising corresponding holes therethrough for mounting the stackable housing.

22. The stackable housing of claim 19, further comprising means integrally formed on the first and second housing members, and on the first exterior insert member for securing the stackable housing together and for securing a transformer within the stackable housing.

23. A housing for enclosing a transformer, the housing having a first housing member and a second housing member, comprising:

an insert member between the first housing member and the second housing member, the insert member having a first end and a second end, a portion of the first end of the insert member engaging the first housing member and a portion of the second end of the insert member engaging the second housing member, wherein the insert member increases the distance between the first housing member and the second housing member.

24. The housing of claim 23, further comprising a plurality of insert members including a first insert member adjacent the first housing member, a second insert member adjacent the second housing member and at least one additional insert member between the first and second housing members, each insert member having a first end and a second end, wherein the first end of the first insert member engages the first housing member, wherein the second end of the second insert member engages the second housing member, and wherein the additional insert members engage adjacent insert members to form the transformer housing.

25. The housing of claim 24, further comprising an interior insert member having a first end and a second end, a portion of the first end of the interior insert member engages the first housing member and a portion of the second end of the interior insert member engages the second housing member such that the interior insert member is located within the confines of the insert member.

* * * * *